US009062675B2

(12) United States Patent
Dixon et al.

(10) Patent No.: US 9,062,675 B2
(45) Date of Patent: Jun. 23, 2015

(54) ROTARY LOBE PUMP WITH WIPER BLADES

(71) Applicants: Randy Dixon, Billings, MT (US); Brett Howell, Spokane Valley, WA (US)

(72) Inventors: Randy Dixon, Billings, MT (US); Brett Howell, Spokane Valley, WA (US)

( * ) Notice: Subject to any disclaimer, the term of this patent is extended or adjusted under 35 U.S.C. 154(b) by 194 days.

(21) Appl. No.: 13/763,940

(22) Filed: Feb. 11, 2013

(65) Prior Publication Data

US 2013/0216417 A1 Aug. 22, 2013

Related U.S. Application Data

(60) Provisional application No. 61/597,569, filed on Feb. 10, 2012.

(51) Int. Cl.

| | |
|---|---|
| ***F01C 19/02*** | (2006.01) |
| ***F01C 1/18*** | (2006.01) |
| ***F04C 15/00*** | (2006.01) |
| ***F04C 2/08*** | (2006.01) |
| ***F04C 2/12*** | (2006.01) |

(52) U.S. Cl.
CPC ..... *F04C 15/0015* (2013.01); *F04C 2/084* (2013.01); *F04C 2/126* (2013.01)

(58) Field of Classification Search
CPC ..... F04C 15/0015; F04C 2/084; F04C 2/126
USPC ..... 418/1, 113, 122, 206.6
See application file for complete search history.

(56) References Cited

U.S. PATENT DOCUMENTS

| | | | | | |
|---|---|---|---|---|---|
| 1,005,586 | A | * | 10/1911 | Webb | 418/206.7 |
| 1,023,360 | A | * | 4/1912 | Brauer | 418/99 |
| 1,047,357 | A | * | 12/1912 | Williams | 418/123 |
| 1,348,772 | A | | 8/1920 | Auger | |
| 1,407,496 | A | | 2/1922 | Storey | |
| 1,665,120 | A | | 4/1928 | Wendell | |
| 1,923,268 | A | * | 8/1933 | Jensen | 418/206.1 |
| 2,270,222 | A | * | 1/1942 | Rea et al. | 188/292 |
| 2,380,752 | A | * | 7/1945 | Grieb | 418/123 |
| 2,463,080 | A | | 3/1949 | Beier | |
| 2,491,678 | A | | 12/1949 | McCulloch et al. | |
| 2,519,588 | A | | 8/1950 | McCulloch | |
| 3,162,140 | A | | 12/1964 | Petit | |
| 3,291,059 | A | | 12/1966 | Werra | |
| 3,526,470 | A | | 9/1970 | Swanson | |

(Continued)

FOREIGN PATENT DOCUMENTS

| | | |
|---|---|---|
| FR | 2394670 | 1/1979 |

OTHER PUBLICATIONS

International Search Report and Written Opinion for International (PCT) Patent Application No. PCT/US2013/025499 mailed Apr. 16, 2013, 7 pages.

(Continued)

*Primary Examiner* — Hoang Nguyen

(74) *Attorney, Agent, or Firm* — Sheridan Ross P.C.

(57) ABSTRACT

A positive displacement rotary pump with an improved impeller design integrating replaceable wiper inserts. The impeller generally has or more lobes and an equal number of conjugate surfaces. Each lobe has an arcuate peripheral end comprising a plurality of wiper blades. The wiper blades improve efficiency by making a seal with a pump chamber or the conjugate surface on the other impeller as it rotates. The wiper blades are arranged such that constant and successive contact between wiper blades and impellers is achieved.

18 Claims, 6 Drawing Sheets

(56) References Cited

U.S. PATENT DOCUMENTS

| | | | |
|---|---|---|---|
| 3,715,169 | A | 2/1973 | Molis |
| 3,832,105 | A | 8/1974 | Takahashi |
| 3,947,149 | A | 3/1976 | MacManus |
| 3,964,840 | A | 6/1976 | Kamelmacher |
| 4,057,375 | A | 11/1977 | Nachtrieb |
| 4,347,035 | A | 8/1982 | Stahle |
| 4,390,331 | A | 6/1983 | Nachtrieb |
| 4,435,126 | A | 3/1984 | Schneider |
| 4,443,158 | A | 4/1984 | Bentele et al. |
| 4,453,901 | A | 6/1984 | Zimmerly |
| 4,518,333 | A | 5/1985 | Seki et al. |
| 4,540,334 | A | 9/1985 | Stahle |
| 4,637,780 | A | 1/1987 | Grayden |
| 4,657,491 | A | 4/1987 | Frank |
| 4,697,996 | A | 10/1987 | Dantlgraber |
| 4,775,112 | A | 10/1988 | Urso |
| 4,815,882 | A | 3/1989 | Ohminato |
| 4,859,158 | A | 8/1989 | Weinbrecht |
| 4,881,697 | A | 11/1989 | Kaneko |
| 5,006,053 | A | 4/1991 | Seno |
| 5,090,879 | A | 2/1992 | Weinbrecht |
| 5,133,638 | A | 7/1992 | Mosure |
| 5,154,149 | A | 10/1992 | Turner |
| 5,335,640 | A | 8/1994 | Feuling |
| 5,348,444 | A | 9/1994 | Metzinger et al. |
| 5,379,881 | A | 1/1995 | Kohler |
| 5,439,358 | A | 8/1995 | Weinbrecht |
| 5,458,459 | A | 10/1995 | Hubbard et al. |
| 5,468,132 | A | 11/1995 | Snell et al. |
| 5,567,140 | A | 10/1996 | Dodd |
| 6,053,717 | A | 4/2000 | Dixon |
| 2007/0189913 | A1 | 8/2007 | Atkins |

OTHER PUBLICATIONS

International Preliminary Report on Patentability for International (PCT) Patent Application No. PCT/US2013/025499, mailed Aug. 21, 2014 6 pages.

* cited by examiner

ROTARY LOBE PUMP WITH WIPER BLADES

RELATED APPLICATIONS

This Non-Provisional Patent Application claims the benefit of priority from U.S. Provisional Patent Application No. 61/597,569, filed Feb. 10, 2012, the entire disclosure of which is hereby incorporated by reference in its entirety.

FIELD OF THE INVENTION

The present invention relates to an improved semi-positive displacement rotary pump. More particularly, the pump has an improved impeller with a replaceable wiper inserts in the impeller lobes to improve the efficiency and performance.

BACKGROUND

The prior art includes many rotary pumps for pumping liquids such as water, oil, gasoline, and other materials. In such pumps, the tolerance of clearance between the impellers and the pump chamber is critical to the proper functioning of the pump. The clearance must be great enough so the impellers do not touch a pump chamber wall and destroy various components of the pump, yet small enough that the pump operates efficiently and with minimal vibration by pushing the liquid through the pump chamber. Moreover, such pumps must be made out of materials that can maintain the required critical tolerance and withstand extreme vibration. As such, rotary pumps are expensive to manufacture and may suffer from a lack of a high degree of tolerance. Furthermore, many rotary pumps are difficult and expensive to maintain since after excessive wear, the entire impeller(s) require replacement.

U.S. Pat. No. 1,348,772 to Auger, which is hereby incorporated by reference in its entirety, teaches the use of packing material, such as felt, on an end of each lobe of a rotary pump to help increase the efficiency of the pump. However, packing materials wear out quickly which reduces efficiency of the pump unless the packing material is replaced frequently. Additionally, materials such as felt are semi-porous which allows flow though the material and reduces efficiency. Furthermore, the packing material may come loose from the lobe at high speeds as the pump impellers rotate, which greatly reduces the efficiency of the pump, rendering it unusable.

U.S. Pat. No. 6,053,717 to Dixon discloses a rotary pump with a wiper feature incorporated in lobes of an impeller and is hereby incorporated by reference in its entirety. U.S. Pat. No. 6,053,717 to Dixon fails to disclose various novel aspects of the present invention including, for example, a pump whereby at least one wiper is in contact with at least one lobe throughout a full rotation (360°) of the pump. An impeller lobe is most efficient when in extremely close proximity with either a housing or another impeller. Without a small tolerance between the impeller lobe and either the housing or other impeller, excessive backflow occurs resulting in lower efficiency. Additionally, the interaction between the area where the surface of one lobe tip comes in close proximity with the other impeller can cause hydraulic hammering which causes vibration and unnecessary wear of the shaft bearings. A general need is recognized to reduce the void and increase the degree of contact and communication between the lobe tip and either the housing or other impeller while limiting vibration and damage to the pump.

Therefore, there is a need for a rotary pump having a high degree of tolerance which is relatively inexpensive to manufacture, maintains contact with either the interior chamber wall or other impeller, has an increased-wear replaceable wiper blades which does not come loose at high speeds, and which can be changed quickly and efficiently without significant expense.

SUMMARY OF THE INVENTION

Therefore, it is an object of the present invention to improve the efficiency of a rotary pump and to reduce the manufacturing costs of making such a pump. It is a further object of the present invention to provide an improved impeller which has removable, extended-wear wiper blades which can be replaced quickly and cost effectively. Another object is to assure contact between the wiper blades and either the housing or other impeller by a spring or other biasing means and by the shape of the interior chamber wall and other impeller. Another object is that each wiper blade has a retention means which keeps the wiper blade attached to the impeller lobe during high rotational speeds of the impellers. A further object is to provide a more efficient path of action between two lobes and/or a housing by increasing the locus of successive contact points therebetween.

In one embodiment of the present invention, a positive displacement rotary pump is provided with an improved impeller having a plurality of lobes, each of the lobes comprising a plurality of removable wiper blade inserts with a surface in substantially constant contact with the chamber wall of the pump. Such an impeller improves the efficiency of the pump while decreasing the manufacturing cost of the pump as a result of reduced tolerances between the pump chamber wall and the end of the wiper blade. Spring or biasing means provided in connection with the blades provide a force against the wiper insert within an impeller of the present invention, maintaining the wiper insert in substantially constant contact with the interior chamber wall of a pump or other impeller, even after significant wear of the wiper insert.

In a preferred embodiment, an impeller comprises generally rounded lobes for increasing contact points and creating a longer path of action with respect to additional components. The generally rounded lobes comprise wiper inserts disposed generally radially thereon. Wiper inserts are preferably distributed on a lobe at even radial spacing. In one embodiment, three wiper inserts are disposed along a radial terminus of a lobe. It will be expressly recognized, however, that the present invention is not limited to a three-wiper arrangement. It is contemplated that lobes of the present invention may comprise any number of wiper inserts on a lobe terminus.

In one embodiment, a pump is provided with a plurality of wiper inserts where each of the wiper inserts comprise a biasing member for biasing the wiper inserts in a radially outward manner thereby facilitating contact between wiper inserts and lobe features.

The present invention provides a novel timing sequence of a plurality of pump lobes which, in various embodiments, enables the pump to run dry for an indefinite time period without adversely affecting the pump components.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
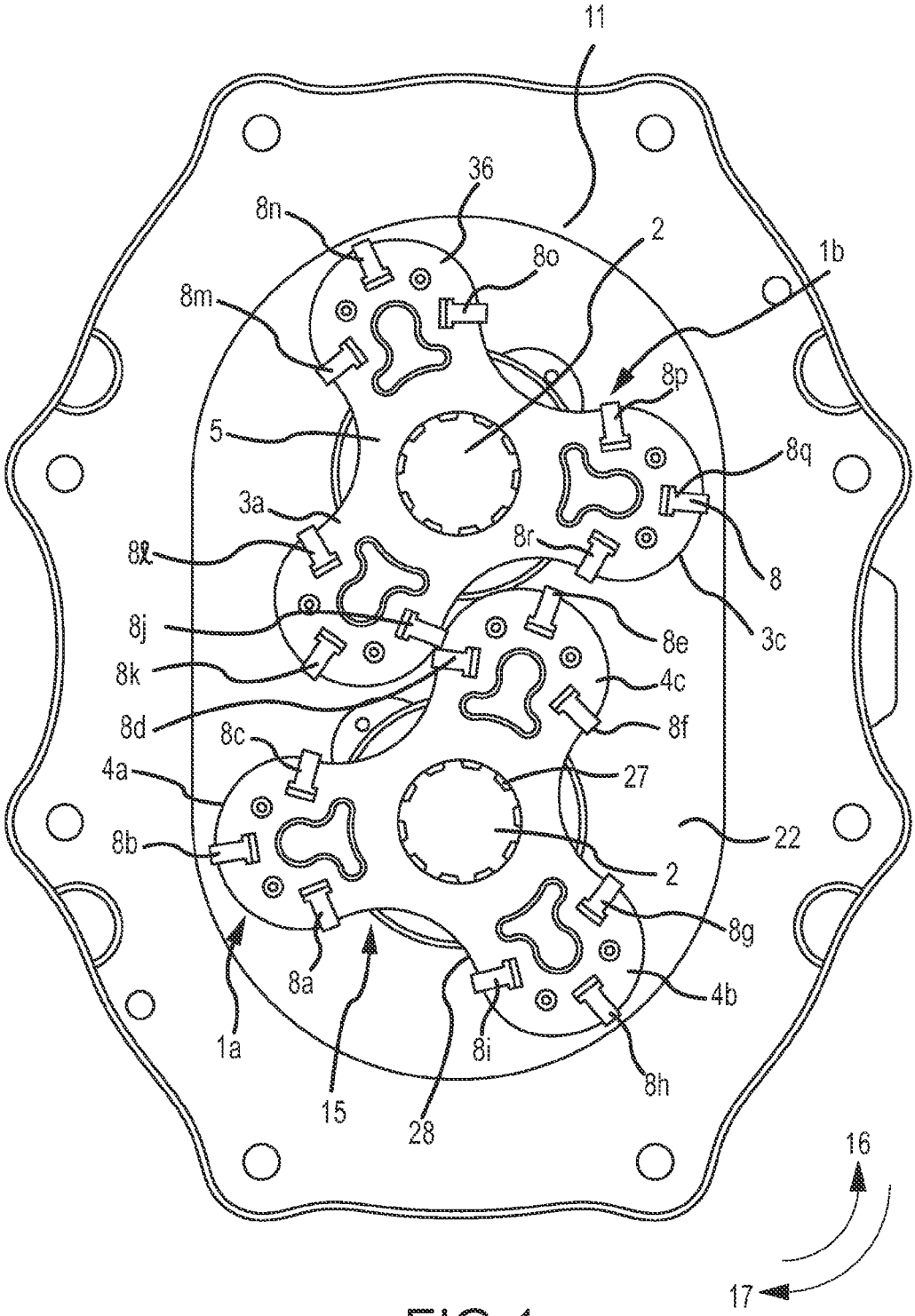

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

The present invention has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention, the invention being measured by the appended claims and not by the details of the specification.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

BRIEF DESCRIPTION OF THE DRAWINGS

It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

Figure 2:
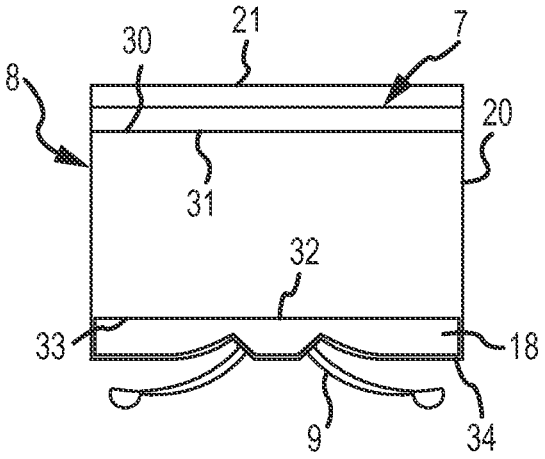
Figure 3:
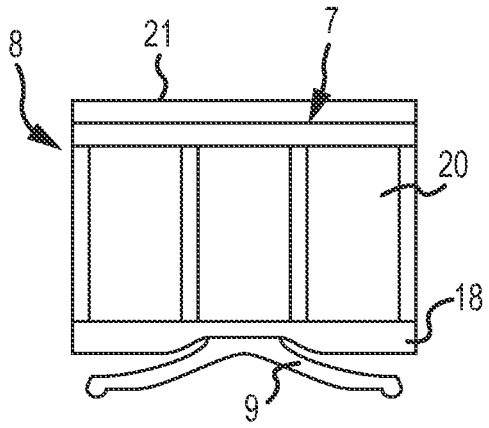
Figure 4:
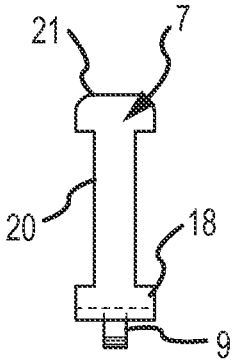
Figure 5:
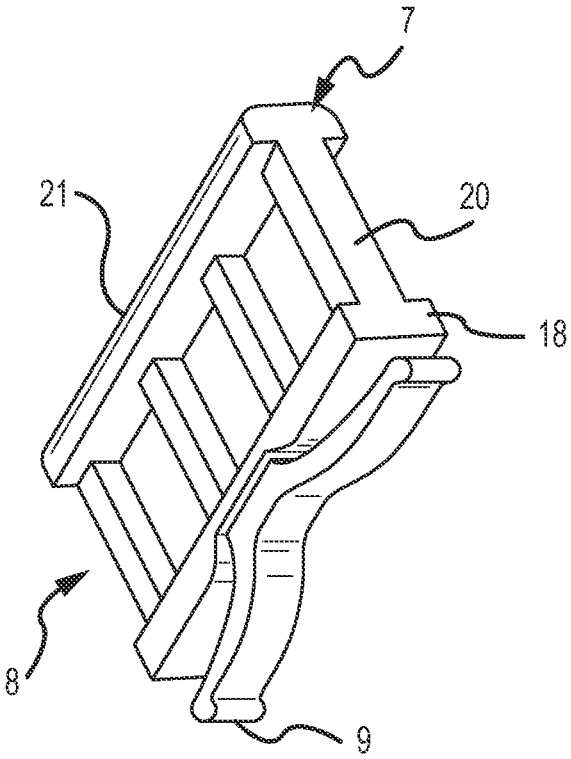
Figure 6:
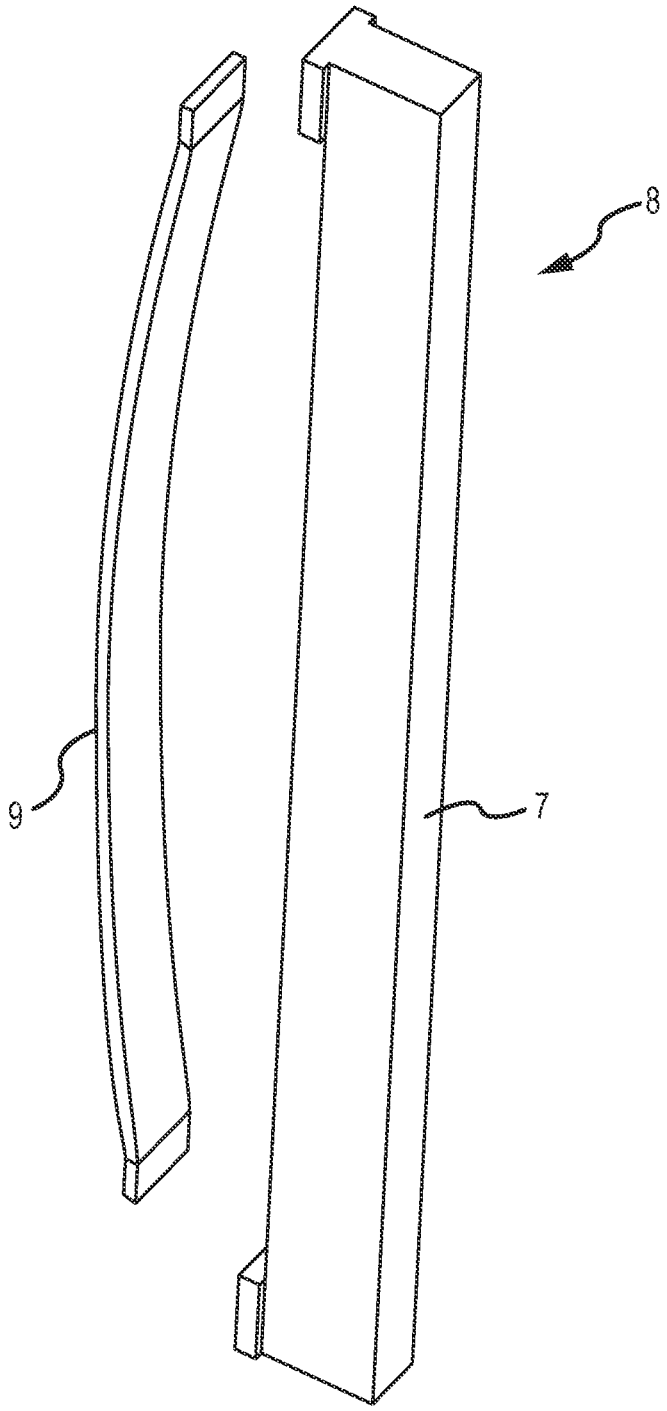
Figure 7:
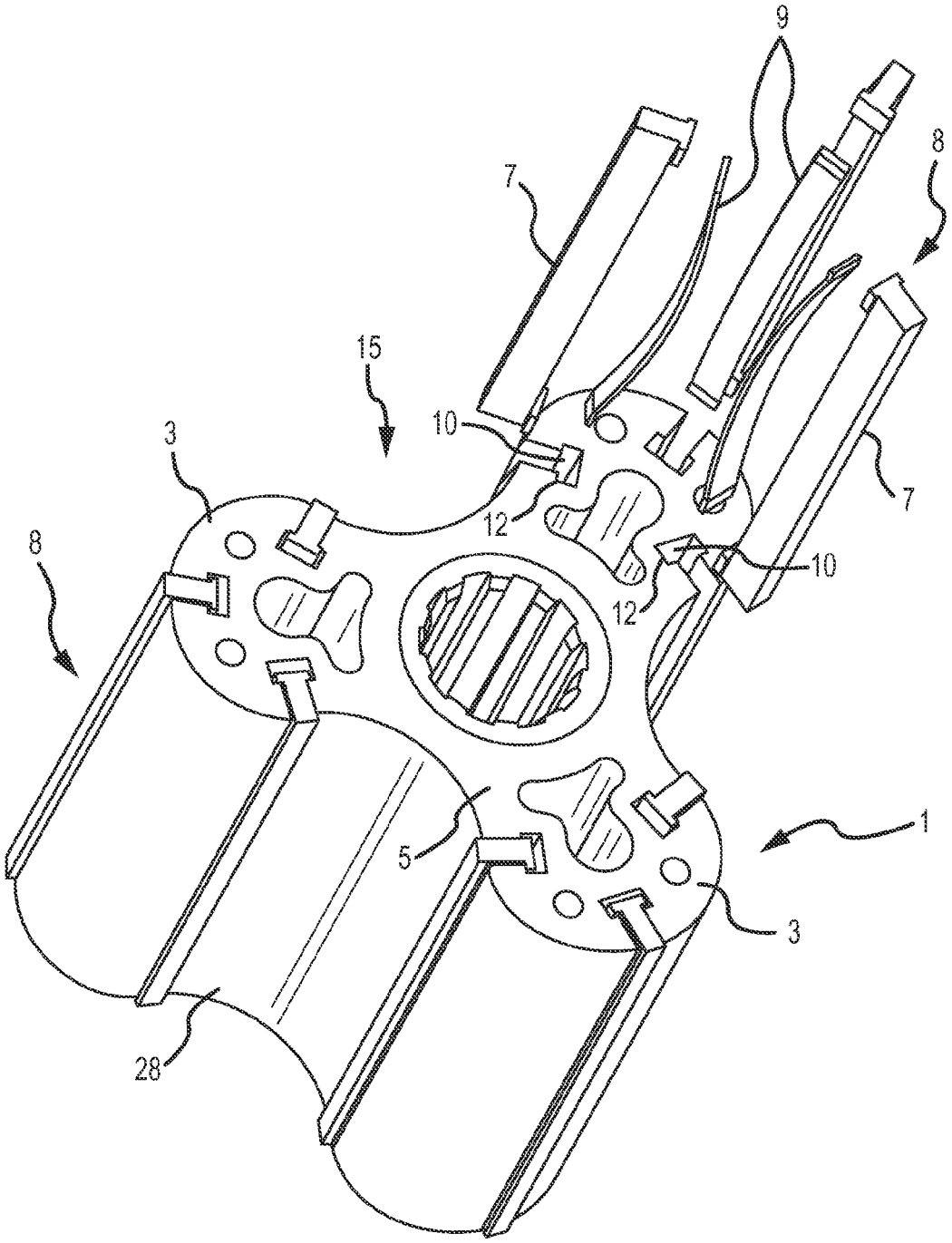
Figure 8:
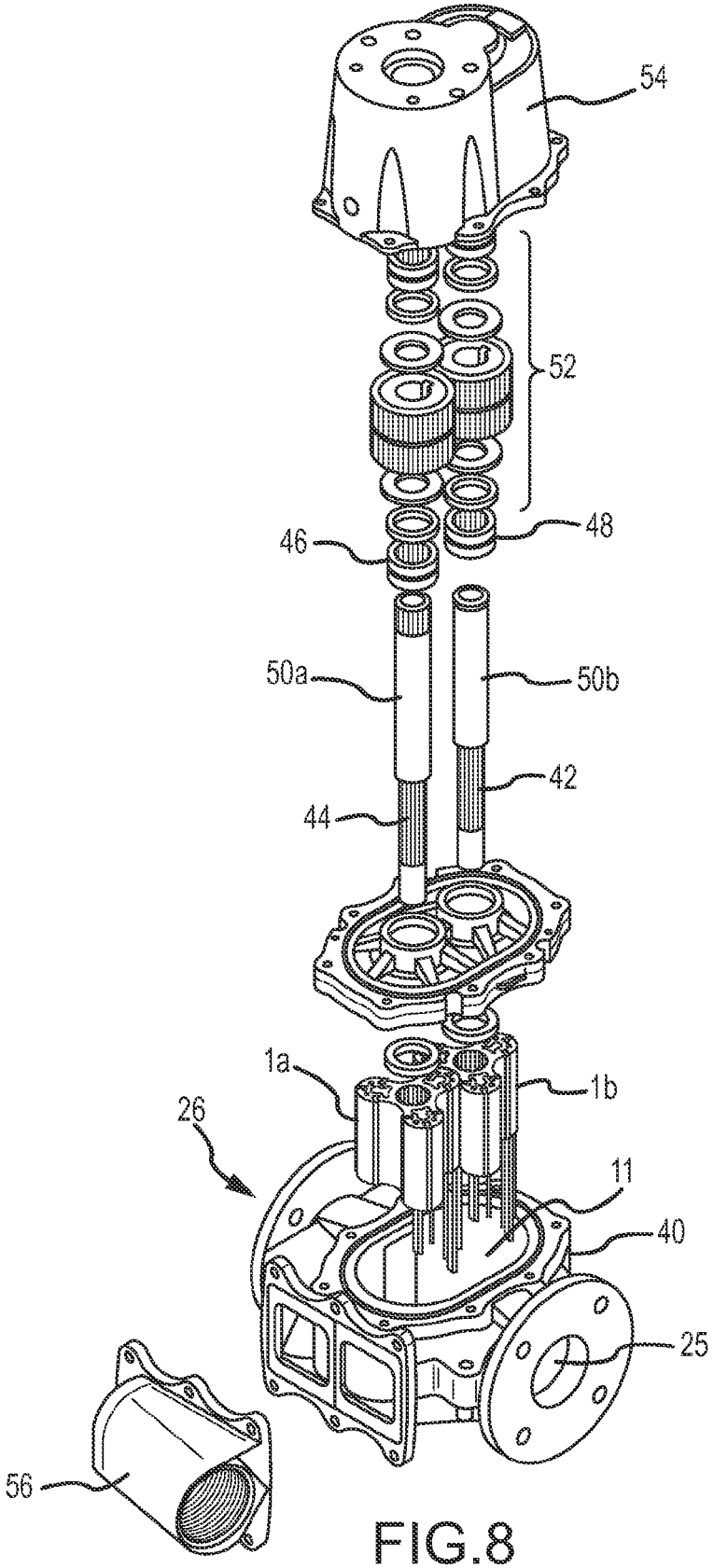

FIG. 1 is a top view of rotary impellers within a housing;

FIG. 2 is a side view of a wiper blade according to one embodiment;

FIG. 3 is a side view of a wiper blade according to one embodiment;

FIG. 4 is a front view of a wiper blade according to one embodiment;

FIG. 5 is a perspective view of a wiper blade according to one embodiment;

FIG. 6 is an exploded perspective view of a wiper blade assembly according to one embodiment;

FIG. 7 is an exploded perspective view of one embodiment of the present invention; and FIG. 8 is an exploded perspective view of one embodiment of the present invention.

DETAILED DESCRIPTION OF THE INVENTION

The present invention generally relates to an improved semi-positive displacement rotary pump. More particularly, the present invention provides an improved impeller for use in a rotary pump.

Referring now to FIG. 1, impellers 1*a*, 1*b* are provided with a plurality of wiper inserts 8 which are secured about a periphery of one or more impeller lobes 3. In one embodiment, the wiper inserts 8 are operatively positioned near or within a cavity 10 of the impeller lobe 3 such that the wiper insert 8 is in direct contact with an interior chamber wall 11 of a pump chamber 22 or a substantially arcuate cut-out portion of the other impeller. Thus, the efficiency of the pump is improved compared to conventional rotary pumps which require a gap between the end of the impeller lobe peripheries 4 and the chamber wall 11 or other impeller to prevent excessive vibration.

One advantage of the improved impeller for a rotary pump of the present invention is that the close tolerances of the clearance of the impellers 1*a*, 1*b* and the pump chamber 11 are not critical due to the impeller and wiper blade 8 design. In contrast, manufacturing tolerances which allow for the clearance of impellers 1*a*, 1*b* and pump chamber walls 11 as shown in the prior art are very critical. In these pumps, if the components are not within tolerance, the pump will not work due to loss of suction capacity and/or excessive vibration. In the pump of the present invention, the tolerances are not as critical, because the wiper insert is biased to extend outward from the lobe periphery 4 until prevented by the retention means which interferes with a wiper insert stop. This ability to extend to varying degree allows the wiper blade 8 to remain in substantial constant contact with the pump chamber wall 11 or other impeller assures peak efficiency.

FIG. 1 illustrates the ability for the wipers to mask large manufacturing tolerances. If the impellers 1*a*, 1*b* were perfectly centered within the interior chamber wall 11, the extension would be the same for each wiper insert 8 as it passes the chamber wall 11. As shown in the FIG. 1, the wiper inserts 8 remain in contact with the chamber wall 11 even though the distance between the lobe tip 4 and the chamber wall 11 changes.

Therefore, the pump of the present invention is less expensive to produce and can be made from a wider variety of materials than pumps previously utilized for similar uses. Prior to the present invention, similar pumps had to be made out of certain metals such as cast iron, aluminum, bronze, brass, and ferrous type metals, because the tolerances and the need to minimize vibration of the pump were critical. However, the wiper insert 8 improvement of the present invention allows the pump to be constructed with lower tolerances (i.e., greater distance between the pump chamber wall 11 and the impeller peripheries 3, 4). Thus, the pump can be made out of numerous types of materials, including, but not limited to, cast iron, bronze, stainless steel, fiberglass, plastic, aluminum, engineered polymers, thermoplastics, rubber composites, foam rubber and ferrous type metals.

As further shown in FIG. 1*a*, 1*b* impellers 1 are provided with a plurality of wiper inserts 8*a*-8*s* such that at least one wiper insert is in contact with a corresponding impeller at all times during pump operation. Whereas known devices provide wipers which do not provide constant contact, the present invention provides a novel arrangement of wiper features whereby the wipers 8*a*-8*s* are rotationally dispersed along the periphery 3, 4 of a lobe such that at least one wiper is in contact with at least one lobe regardless of rotational position of the impeller(s) 1*a*, 1*b*.

For example, and still referring to FIG. 1, an impeller 1*a* according to one embodiment comprises three lobes 4*a*, 4*b*, 4*c*, each of said lobes comprising three wiper inserts 8. At the position shown, wiper 8*c* is in contact with a lobe 3*a* of the opposing impeller 1*b*. As impeller 1*a* rotates in a counter-clockwise manner, for example, opposing impeller 1*b* will co-rotate in a clock-wise manner. Upon such rotation, wiper insert 8*d* will rotate out of contact with the lobe 3*a* of impeller 1*b*. Prior to complete disengagement between wiper insert 8*d* and lobe 3*a*, however, wiper insert 8*e* will rotate to contact impeller 1*a*. Similarly, prior to wiper insert 8*j* disengaging from impeller 1*a*, a succeeding wiper insert 8*e* will contact the lobe 3*c* and/or arcuate cut-out portions 15 of impeller 1*b*. One of skill in the art will recognize that this progression will continue from one insert 8 to the next and from one lobe to the next in such a manner that at least one wiper insert 8 is in contact with a lobe at all rotational positions of the pump. It will be further recognized that the number and placement of wiper inserts 8 may be varied without deviating from the scope or spirit of the present invention. Thus, it will be expressly recognized that pumps of the present invention are not limited to impellers having three lobes and/or three wiper inserts disposed on said lobes.

Yet another advantage of the improved rotary pump of the present invention is that the suction capability of the pump may be significantly and reliably increased over the suction capability of other rotary pumps since the wiper inserts of the present invention are more efficient, non-porous and wear evenly. A tighter seal is created during rotation because of constant contact of the wiper blade insert 8 with the chamber wall 11, which improves pump efficiency over the life of the wiper insert.

As shown in FIG. 2, a spring or biasing means 9 improves the wear life of the blade 7 because it will extend the wiper insert as the blade 7 wears. Additionally, there is little chance the wiper insert 8 will detach from a lobe periphery at high speeds because of the interaction between the retention means 18 and a wiper stop 12 within the cavity 10 (see. FIG. 7). Subsequently, the pump suction performance is increased along with output performance and reliability.

Another advantage of the improved rotary pump of the present invention is that the wiper insert 8 is easy to replace, making it possible to maintain a tight seal for the life of the pump. Wiper inserts 8 of the present invention can be manufactured from a variety of materials including, but not limited to, rubber, nitrile, viton, polymers, nylon based resins, foam rubber, teflon and any other material which is generally wear-resistant and conducive to frictionally engage the surface of the pump chamber wall. Such a material can be selected to be compatible with materials from which the pump chamber wall 11 and impeller is constructed. Preferably, the wiper insert 8 is additionally compatible with the fluid serviced through the pump and thus custom designed for the particular pump application.

As shown in FIGS. 1 and 7, a rotary pump of the present invention can have one or more impellers 1*a*, 1*b*. In a preferred embodiment, a pump of the present invention has two axially symmetrical impellers. Each impeller 1 can turn either a forward 16 or reverse 17 direction which will define the flow of fluid through the pump. Normally, the fluid flows from a fluid inlet to the fluid outlet, but the flow direction may be changed by reversing the rotation direction of the impellers. In certain embodiments, each shaft 2 is independently driven so the impellers 1 do not touch each other nor do the lobes 3, 4 of the impellers 1 touch the pump chamber wall 11. The impellers 1 are designed to fit within the chamber of the pump 22. There must be clearance between the lobe 3, 4 peripheries of the impeller 1*a*, 1*b* and the pump chamber wall 11 because, as described above, the tolerance of this clearance is not critical due to the novel wiper blade 7 features. Enough clearance is provided between the lobe periphery and the chamber wall 11 for the wiper blade 7 at minimum extension.

Impellers of the present invention can have one or more lobes 3, 4. Preferably, an impeller of the present invention comprises three lobes. Each lobe 3, 4 of the impeller 1 has a first end or periphery, located proximal to the pump chamber wall 11, and a second end 5, located proximal to a central axis 2. The lobes 3 are commonly disposed approximately 120° apart in a preferred embodiment.

Each impeller 1 has a plurality of substantially arcuate cut-out portions 15. Each of the substantially arcuate cut-out portions 15 having a conjugate surface 28. The wiper insert 8 forms one or more seals over the conjugate surface 28.

The interaction between the wiper blade 7 and the conjugate surface 28 as the impellers 1 rotate, as well as the constant contact achieved therebetween, provide higher pump efficiency without any hydraulic hammering effect which causes unwanted vibration in the prior art.

According to one embodiment, each lobe periphery 4 has an interconnection means for securing a wiper insert 8 within a lobe. In certain embodiments, interconnection means are formed to removably, yet securely, hold the wiper insert 8 of the present invention such that the wiper insert 8 extends beyond the impeller lobe periphery and is maintained in substantially constant contact with the pump chamber wall 11 and/or conjugate surface 28 during rotation of the impeller. Insertion and assembly of the wiper blades are further shown in FIG. 7.

Referring now to FIGS. 2-5, wiper inserts 8 according to certain embodiments of the present invention comprise a shape adapted to fit securely to the interconnection means. Preferably, the wiper insert 8 comprises the blade 7, elongated portion 20, retention means 18, and biasing means 9. Referring to FIG. 2, the wiper blade 7 has a distal edge 21 and proximal end 30. The elongated portion 20 has an outward end 31 and an inward end 32, with the outward end 32 attached to the proximal end 30 of the wiper blade. The retention means 18 has a primary end 33 and secondary end 34 where the primary end 33 is connected to the inward end 32 of the elongated portion 20. The wiper blade 7 can be of any form capable of maintaining substantially constant contact with the pump chamber wall 11 or conjugate surface 28 when attached to an impeller lobe. The blade portion 7 is joined to the elongated portion 20 of the wiper insert 8 such that the edge 21 of the blade 7 is in substantially constant contact with the pump chamber wall 11 or conjugate surface 28.

FIGS. 3-5 depict one embodiment of a wiper insert 8 according to the present invention. FIG. 3 is a front plan view thereof. FIG. 4 is a side elevation view thereof. FIG. 5 is a bottom perspective view thereof. As shown, biasing means 9 are provided to bias the insert 8 outwardly toward a pump chamber wall and/or an opposing impeller (not shown). An elongated portion 20 of the insert comprises ribs and/or cutout portions to reduce weight of the insert, and thus providing a more responsive movement of the insert 8 as impacted by the biasing means 9 and any external forces. A blade portion 7 is provided, having a partially rounded shoulder. The edge 21 of the blade 7 is adapted for contacting pump chamber and impeller features as shown and described herein, thus increasing efficiency of a pump.

FIG. 6 is an exploded perspective view of a wiper insert 8 according to a preferred embodiment of the present invention. As shown, the wiper insert 8 comprises a biasing element 9 which is in the form of a leaf spring and a wiper blade 7. When assembled, the blade 7 is biased outwardly due to the biasing force of the element 9 and its contact with a portion of a pump lobe. As used herein, the term "bias" refers to either linear or non-linear bias and should not be read or interpreted as being limited to one or the other. Peripheral ends of the biasing element 9 may be inserted into corresponding ends of the wiper 7 to create a pre-tensioned state and/or secure the biasing element 9 to the wiper 7. Accordingly, in one embodiment, it is contemplated that the biasing element 9 is secured within the wiper 7 via slots or tracks in the wiper 7. In alternative embodiments, it is contemplated that the biasing member 9 is secured to the wiper 7 via a variety of known devices, means, and methods including, but not limited to, various fasteners.

FIG. 7 is a partially exploded perspective view of an impeller 1 having lobes 3, each of the lobes 3 having wiper inserts 8. For illustration purposes, FIG. 7 shows one lobe 3 with wiper inserts 8 in an unassembled state. Wiper inserts 8, including biasing elements 9 and blades 7, may be assembled and inserted into a cavity provided in the lobe 3. Accordingly, the present invention provides for a wiper insert 8 that may be assembled, removed, repaired and/or replaced with relative ease.

FIG. 7 provides a perspective view of an impeller 1 with a plurality of lobes 3, each of the lobes 3 comprising a plurality of wiper inserts 8. The wiper inserts comprise a blade portion 7 and a biasing portion 9. Biasing portion and/or at least a portion of the blade 7 are received within interconnection means which, in at least one embodiment, comprise slots 10 with one or more shelf features 12 to prevent radial dislocation of the insert(s) 8. The interconnection means generally comprise channels extend along a depth of the impeller 1 and are substantially equivalent in length to the insert(s) 8.

Interconnection means, however, can be any shape, geometry, or arrangement suitable for holding the wiper insert 8 of the present invention in such a manner. Preferably, interconnection means comprise one or more cavities. The cavities comprise a narrow opening at a most distal edge of the lobe periphery such that the blade 7 of the wiper insert 8 is projected through the opening, while at least a portion of the blade member 7 and biasing member 9 is positioned within the cavity or channel.

In one embodiment, an impeller of the present invention has a biasing means 9 which is situated between the wiper insert and a back edge of the wiper insert cavity 10. The biasing means 9 provides substantially constant pressure on the wiper insert 8 such that the wiper insert 8 is pushed toward a pump chamber wall 11 or conjugate surface 28. That is, the biasing means 9 when compressed will have a tendency to expand outwardly toward the chamber wall 11 or conjugate surface 28. This biasing provides for extended wiper blade 7 life and improved pump efficiency. In one embodiment, the biasing means 9 comprises a mechanical type spring. Such a biasing element can be metal, plastic, rubber, or any similarly appropriate material. In another embodiment, the biasing means 9 comprises the material utilized for the wiper insert 8 as shown in FIGS. 2-5. The biasing means 9 can be rated at different tensions to accommodate wear factors of different materials. These materials include, but are not limited to rubber, nitrile, viton, teflon, polymers, nylon based resins, foam rubber, or any material with expansive properties.

A preferred embodiment of a rotary pump of the present invention is depicted in FIG. 8. As shown, a semi-positive displacement, gear driven, rotary pump is shown which is timed and synchronized, with independently timed impellers 1*a*, 1*b*. The pump comprises a cylindrical housing 40 generally having arcuate interior chamber walls 11. The walls are separated by a fluid inlet space joined to a fluid inlet 25. The rotary pump of the present invention can be made with virtually any size inlet 25 and outlet 26 depending on the application. The pump of the present invention has a motorized or hand driven pump head coupled axially to the shafts 42, 44 to rotate the impellers 1*a*, 1*b* and impart mechanical energy to the fluid.

Bearings are used in a pump of the present invention to reduce friction. Such bearings are coupled, for example, to the axial shafts 42, 44. Preferably, the pump of the present invention comprises needle bearings 46, 48. Needle bearings used in a pump of the present invention provide significant advantages. For example, needle bearings are manufactured to hold closer tolerances, extend the life of the pump significantly, and allow less friction between pump components. Less energy is required to operate the pump due to better suction and discharge performance of the pump, thus requiring less maintenance than other types of bearings.

The pump comprises sleeves 50*a*, 50*b* pressed onto the shafts 42, 44 which provides strength to the shafts 42, 44. More particularly, the sleeves comprise an inner race for the bearing, which is pressed onto the shafts 42, 44. The sleeves generally increase the life of the bearing and the shafts because the bearing and sleeve, or inner race, are constructed of the same metals and therefore have the same hardness. This design enables the use of unlimited types of material to make the pump shafts. Additional sealing and gearing elements 52 are provided and generally housed within pump housing features 40, 54. Pressure safety means are provided, including exhaust port housing 56 for containing a safety valve.

The pump has seals comprised of mechanical seals, spring seals, packed seals, porcelain seals, spring reinforced lip seals, or any seal that physically fits the housing and shaft of the pump of the present invention. Preferably, the pump has high-pressure lip seals.

Devices of the present invention have been shown to provide significant, unexpected, and non-obvious improvements over prior art devices. As further illustrated by representative test data provided below, a 1.5" pump comprising features of the present invention has been shown to achieve efficiency levels between approximately 93% and 98%.

TABLE 1

1.5" Pump with Short Impellers @ 0 PSI

| RPM | Vacuum (PSI) | GPM | Theor. GPM | % Efficiency |
|---|---|---|---|---|
| 100 | 23.5 | 5 | 5.6 | 89% |
| 200 | 24 | 10 | 11.2 | 89% |
| 300 | 24 | 16 | 16.8 | 95% |
| 400 | 24 | 22 | 22.4 | 98% |
| 500 | 23 | 27 | 28 | 96% |
| 600 | 23.5 | 31 | 33.6 | 92% |
| 700 | 23 | 36 | 39.2 | 92% |
| 800 | 23 | 39 | 44.8 | 87% |
| 900 | 23 | 44 | 50.4 | 87% |
| 1000 | 23 | 47 | 56 | 84% |
| 1100 | 22.5 | 52 | 61.6 | 84% |

TABLE 2

1.5" Pump with Long Impellers @ 0 PSI

| RPM | Vacuum | GPM | Theor. GPM | % Efficiency |
|---|---|---|---|---|
| 100 | 22.5 | 8 | 7.7 | 104% |
| 200 | 23 | 14 | 15.4 | 91% |
| 300 | 23 | 22 | 23.1 | 95% |
| 400 | 23 | 28 | 30.8 | 91% |
| 500 | 23 | 34 | 38.5 | 88% |
| 600 | 22.5 | 41 | 46.2 | 89% |
| 700 | 23 | 46 | 53.9 | 85% |
| 800 | 22.5 | 52 | 61.6 | 84% |
| 900 | 22.5 | 56 | 69.3 | 81% |

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A rotary pump, comprising:

a pump chamber having an interior chamber wall;

a first impeller and a second impeller disposed within said pump chamber, each of said impellers comprising:

a hub located substantially in the center of said first impeller and said second impeller, wherein each of said hubs rotates around a central axis of each of said impellers;

three or more lobes extending radially outward from each of said central axes, each of said lobes having a first end and a second end, said second end proximate to said central axis;

said first end comprising a substantially arcuate periphery; and a substantially arcuate cut-out portion between each of said lobes on said impellers, each of said arcuate cut-out portions having a conjugate surface;

each of said lobes comprising a plurality of wiper inserts, wherein each of said wiper inserts operatively engages a conjugate surface when each of said first ends of each of said lobes is proximate to each of said conjugate surfaces;

wherein said plurality of wiper inserts are radially distributed about said substantially arcuate periphery such that at least one of said wiper inserts is in contact with at least one of said impellers throughout rotation of said impellers;

each of said wiper inserts comprising a biasing element for providing a force to each of said wiper inserts in a direction radially outward from each of said central axes, said biasing element comprising a leaf spring and wherein peripheral ends of said leaf spring are inserted into at least one of a slot and a track provided in at least one corresponding end of the wiper insert; and a drive shaft interconnected to each of said hubs, wherein each of said drive shafts independently rotate each of said hubs and said impellers to operatively move fluid through said pump chamber.

2. The rotary pump of claim 1, wherein said conjugate surface further comprises:

a first end and a second end, wherein said wiper inserts travel from said first end to said second end of said conjugate surface as said impeller rotates;

an entry relief having a non-linear rounded surface interconnected to said first end of said conjugate surface; and an exit relief having a non-linear rounded surface interconnected to said second end of said conjugate surface, wherein said entry and exit relief substantially inhibit said wiper inserts from becoming damaged upon entry into said arcuate cut-out portion.

3. The rotary pump of claim 1, wherein said wiper inserts comprise:

a blade having an edge and an inner end;

an elongated portion having an outward end and an inward end, wherein said outward end is interconnected to said inner end of said blade;

a retention means having primary end and secondary end, wherein said primary end is interconnected to said inward end of said elongated portion; and a biasing means interconnected to said secondary end of said retention means.

4. The rotary pump of claim 1, wherein each of said drive shafts is comprised of a motor or a manually driven hand crank.

5. An impeller capable of being rotated within a chamber of a rotary pump, said chamber having an interior chamber wall, said impeller comprising:

at least one lobe extending radially outward from a hub interconnected to a drive shaft, the at least one lobe having a first end and a second end, said first end being proximate to said chamber wall and said second end being proximate to said drive shaft;

said first end comprising a plurality of wiper inserts, said wiper inserts being radially distributed about a periphery of said at least one lobe;

each of said wiper inserts comprising a blade portion and a biasing portion for operative engagement of said interior chamber wall;

each of said biasing portions comprising a first end and a second end with a length therebetween and wherein said first ends and said second ends are selectively received in at least one of a slot and a track in opposing ends of said wiper inserts; and each of said biasing portions operatively interconnected to said lobe and providing a force to bias said blade portions in a direction radially outward from said hub.

6. The impeller of claim 5, wherein each of said wiper inserts comprises rubber, nitrile, viton, teflon, polymers, nylon based resins, or foam rubber.

7. The impeller of claim 5, wherein each of said biasing portions is selectively removable from each of said wiper inserts.

8. The impeller of claim 5, wherein at least one of said biasing portions is a leaf spring.

9. The impeller of claim 5, wherein said impeller comprises a cavity operably sized to receive a portion of said wiper insert and having a general configuration which substantially impedes said wiper insert from becoming disengaged from said impeller.

10. The impeller of claim 5, wherein said impeller comprises a wiper insert stop, said wiper insert stop preventing said wiper insert from dislodging when said impeller rotates at a high rate of speed.

11. The impeller of claim 5, further comprising a substantially arcuate cut-out portion between each of said lobes, each of said arcuate cut-out portions having a conjugate surface, wherein each of said wiper inserts on a first impeller operatively engages a respective conjugate surface on a second impeller in a successive fashion when each of said first ends of said lobes of said first impeller is proximate to said respective conjugate surface of said second impeller.

12. The impeller of claim 11, wherein said conjugate surface further comprises:

a first end and a second end, wherein each of said blade portions of said wiper inserts travel from said first end to said second end of said conjugate surface in a successive manner as said impeller rotates;

an entry relief having a non-linear rounded surface interconnected to said first end of said conjugate surface; and an exit relief having a non-linear rounded surface interconnected to said second end of said conjugate surface, wherein said entry and exit relief substantially inhibit said blade portions of said wiper inserts from becoming damaged upon entry into said arcuate cut-out portion.

13. The impeller of claim 5, wherein at least one of said blade portion and said biasing portion of at least one wiper insert is removably interconnected from said wiper insert.

14. The impeller of claim 5, wherein said biasing portion is a biasing element comprised of metal, plastic, rubber, or polymers with expansion properties.

15. A rotary pump, comprising:

an interior chamber wall;

a first and second impeller located within said interior chamber wall, each of said first and said second impellers having one or more lobes and an equal amount of substantially arcuate cut-out portions alternatively surrounding a hub, said hub substantially in the center of each of said impellers, said arcuate cut-out portions having a conjugate surface;

a plurality of wiper inserts interconnected to each of said lobes, said wiper inserts of said first impeller and said wiper inserts of said second impeller radially distributed about said lobes such that said wiper inserts of said first impeller contact said second impeller and said wiper inserts of said second impeller contact said first impeller in an alternating manner;

each of said wiper inserts comprising a blade portion and a biasing portion, said blade portions adapted to provide a force upon each of said wiper inserts in a direction which is outward from said hub; and an independent drive shaft interconnected each of said first and second impellers, wherein as said first and second impellers rotate said wiper inserts operatively engage said interior chamber wall to push a fluid through said rotary pump.

16. The rotary pump of claim 15, wherein said wiper inserts interconnected to said lobes of said first impeller operatively engage said interior chamber wall or said conjugate surface of said second impeller, and said wiper inserts interconnected to said lobes of said second impeller operatively engage said interior chamber wall or said conjugate surface of said first impeller as said first and second impellers rotate, and wherein at least one of said wiper inserts is in contact with an opposing lobe as said lobes rotate.

17. The rotary pump of claim 15, wherein said conjugate surface further comprises:

a first end and a second end, wherein said wiper insert travels from said first end to said second end of said conjugate surface as said impeller rotates;

an entry relief having a non-linear rounded surface interconnected to said first end of said conjugate surface; and an exit relief having a non-linear rounded surface interconnected to said second end of said conjugate surface, wherein said entry and exit relief substantially inhibit said wiper inserts from becoming damaged upon entry into said arcuate cut-out portion.

18. The rotary pump of claim 15, wherein at least one of said wiper insert is removably interconnected to a lobe.

* * * * *